US005203732A

United States Patent [19]

Cusson

[11] Patent Number: 5,203,732

[45] Date of Patent: Apr. 20, 1993

[54] BALLOON POWERED TOY BOAT

[76] Inventor: René J. Cusson, 4 Burling St., Winooski, Vt. 05404

[21] Appl. No.: 806,201

[22] Filed: Dec. 13, 1991

[51] Int. Cl.[5] ..... A63H 23/06

[52] U.S. Cl. ..... 446/163

[58] Field of Search ..... 446/163, 186, 187, 160

[56] References Cited

U.S. PATENT DOCUMENTS

| | | | |
|---|---|---|---|
| 1,893,507 | 1/1933 | Ranney | 446/163 X |
| 2,624,975 | 1/1953 | Belding | 446/163 |
| 3,246,419 | 4/1966 | Pawelka et al. | 446/163 X |

FOREIGN PATENT DOCUMENTS

| | | | |
|---|---|---|---|
| 1040966 | 10/1953 | France | 446/163 |
| 20081 | of 1892 | United Kingdom | 446/163 |

*Primary Examiner*—Mickey Yu
*Attorney, Agent, or Firm*—Leon Gilden

[57] ABSTRACT

A toy boat includes a hull formed with a stern plate and a bow, with the boat including a first conduit pipe projecting upwardly terminating at an upper distal end to receive a balloon member thereon, with the first conduit pipe in communication with the second conduit pipe, including a valve therewithin to selectively direct pneumatic pressurized air through a second conduit pipe rear distal end projecting below and rearwardly of the stern plate of the boat. A modification of the invention includes a bath oil dispensing reservoir in conjunction with paddle wheels to disperse bath oil simultaneously in utilization of the boat for entertainment and amusement of individuals.

1 Claim, 5 Drawing Sheets

BALLOON POWERED TOY BOAT

BACKGROUND OF THE INVENTION

1. Field of the Invention

The field of invention relates to toy apparatus, and more particularly pertains to a new and improved balloon powered toy boat wherein the same is arranged for amusement and entertainment in enclosed bodies of water, such as in a bathtub.

2. Description of the Prior Art

Balloon powered devices, and particularly toys of various types, are utilized in the prior art. Such a toy structure is exemplified in Allen U.S. Pat. No. 3,613,303 wherein a balloon powered toy car utilizes a turbine-type drive for motivation.

Ralph U.S. Pat. No. 4,096,660 sets forth the use of a balloon powered airplane, wherein the balloon is mounted to a one-piece stick fuselage.

Gilbert U.S. Pat. No. 3,831,315 sets forth a toy rocket launching organization of balloon power.

As such, it may be appreciated that there continues to be a need for a new and improved balloon powered toy boat as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of balloon powered toy apparatus now present in the prior art, the present invention provides a balloon powered toy boat wherein the same is arranged to pneumatically effect propulsion of a boat member within an enclosed body of water. As such, the general purpose of the present invention, which will be described subsequently in greater detail, is to provide a new and improved balloon powered toy boat which has all the advantages of the prior art toy boat apparatus and none of the disadvantages.

To attain this, the present invention provides a toy boat including a hull formed with a stern plate and a bow, with the boat including a first conduit pipe projecting upwardly terminating at an upper distal end to receive a balloon member thereon, with the first conduit pipe in communication with the second conduit pipe, including a valve therewithin to selectively direct pneumatic pressurized air through a second conduit pipe rear distal end projecting below and rearwardly of the stern plate of the boat. A modification of the invention includes a bath oil dispensing reservoir in conjunction with paddle wheels to disperse bath oil simultaneously in utilization of the boat for entertainment and amusement of individuals.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved balloon powered toy boat which has all the advantages of the prior art toy boat apparatus and none of the disadvantages.

It is another object of the present invention to provide a new and improved balloon powered toy boat which may be easily and efficiently manufactured and marketed.

It is a further object of the present invention to provide a new and improved balloon powered toy boat which is of a durable and reliable construction.

An even further object of the present invention is to provide a new and improved balloon powered toy boat which is susceptible of a low cost of manufacture with regard to both materials and labor, and which accordingly is then susceptible of low prices of sale to the consuming public, thereby making such balloon powered toy boats economically available to the buying public.

Still yet another object of the present invention is to provide a new and improved balloon powered toy boat which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
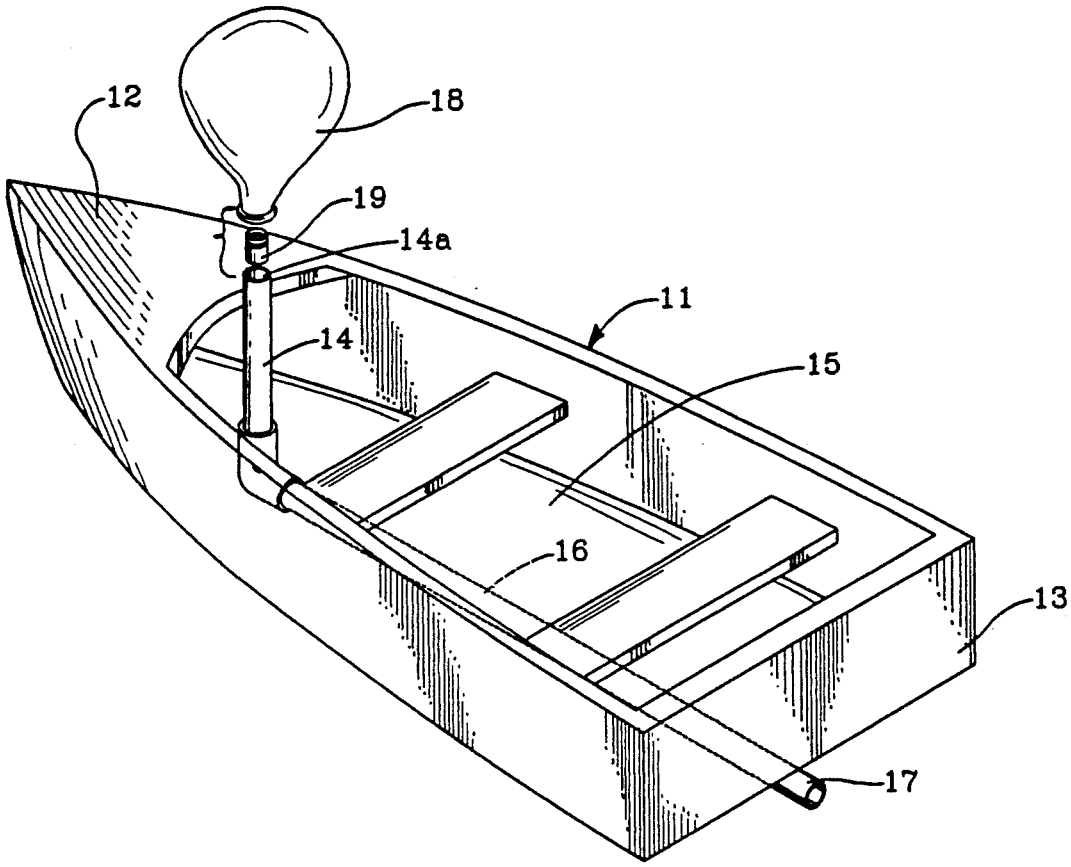
FIG. 1 is an isometric illustration of the instant invention.

With reference now to the drawings, and in particular to FIGS. 1 to 11 thereof, a new and improved balloon powered toy boat embodying the principles and concepts of the present invention and generally designated by the reference numeral 10 will be described.

More specifically, the balloon powered toy boat 10 of the instant invention essentially comprises a boat hull 11, including a bow 12 positioned forwardly and medially of a stern plate 13. A boat floor 15 extends coextensively between the bow 12 and stern plate 13, with boat side walls directed between the bow and the stern plate. A first conduit pipe 14 is included at its upper distal end projecting above the boat hull 11 and particularly the side walls, with the first conduit pipe 14 extending below the boat floor 15 in communication with the second conduit pipe 16 that includes a second conduit pipe rear distal end 17 projecting rearwardly of the stern plate 13. A pneumatic balloon 18 is arranged to include a balloon coupler 19 that is provided with a reducer pipe for securement of the pneumatic balloon 18 to the upper distal end of the first conduit pipe 14.

Figure 2:
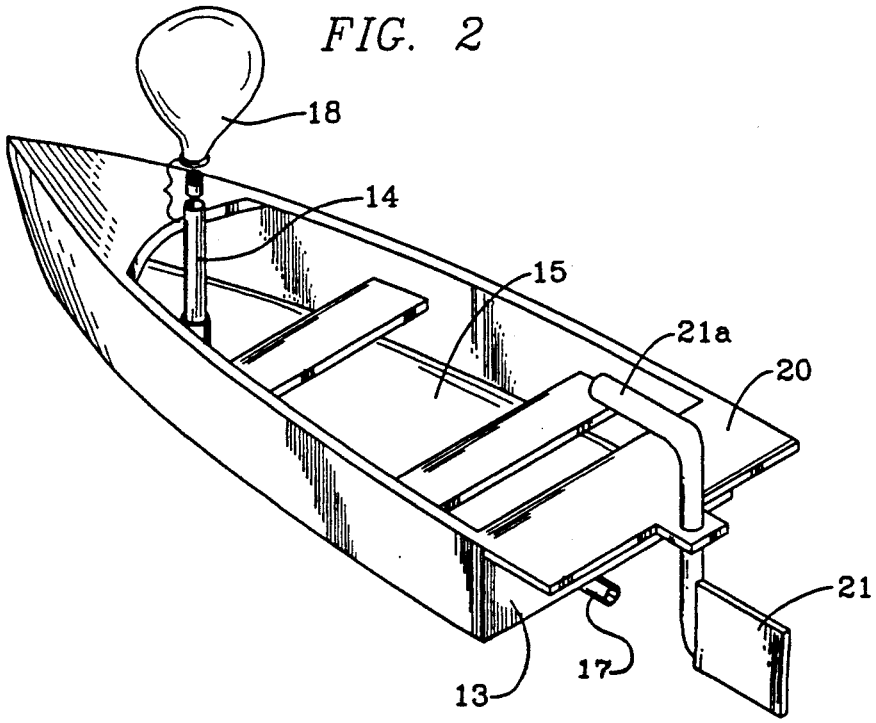
FIG. 2 is an isometric illustration of the invention utilizing a rudder steering device.

The FIG. 2 illustrates a stern flange 20 that projects rearwardly and in an orthogonal relationship relative to the stern plate 13, that includes a rudder 21 rotatably mounted through the stern flange 20, with a rudder projecting below the boat floor 15, including a rudder handle lever 21*a* projecting above the stern flange 20.

Figure 3:
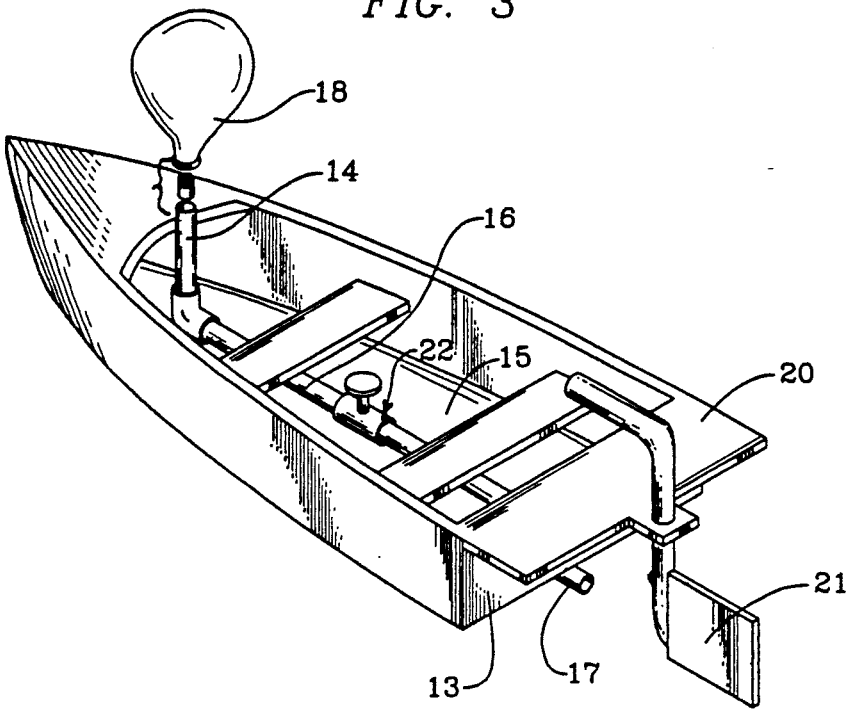
FIG. 3 is an isometric illustration of the invention employing a valve member.
Figure 4:
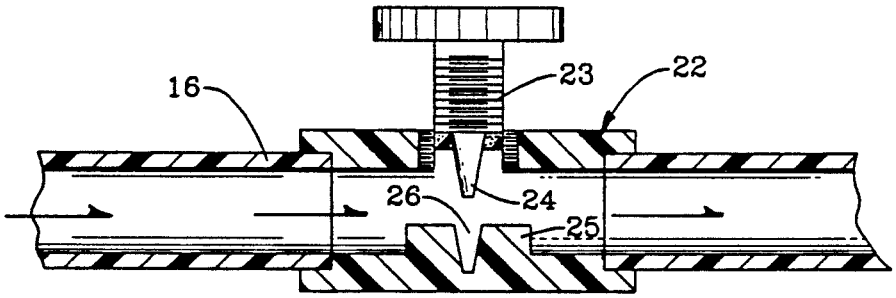
FIG. 4 is an orthographic cross-sectional illustration of the valve member in an opened configuration.
Figure 5:
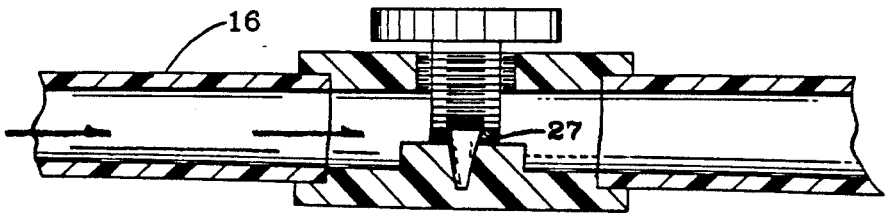
FIG. 5 is an orthographic cross-sectional illustration of the valve member in a closed configuration.

The FIG. 3 illustrates the second conduit pipe 16 extending above the floor 15 for a majority of the predetermined length of the second conduit pipe, wherein a second conduit valve 22 mounted within the second conduit pipe adjacent the floor 15 effects selective enclosing of the second conduit pipe 16 to pneumatic flow therethrough, in a manner as illustrated in FIGS. 4 and 5. The second conduit valve 22 includes a threaded valve rod 23 threadedly received through the second conduit valve 22 cooperating with a valve rod receiving boss 25. The valve rod 23 includes a lower conical end 24 that is received within a conical cavity 26 within the boss 26 as the conical cavity 26 is coaxially aligned with the lower conical end 24. A polymeric seal 27 is arranged in surrounding relationship relative to the lower conical end 24 about a lower portion of the lower conical end 24, as illustrated in the FIGS. 4 and 5.

Figure 6:
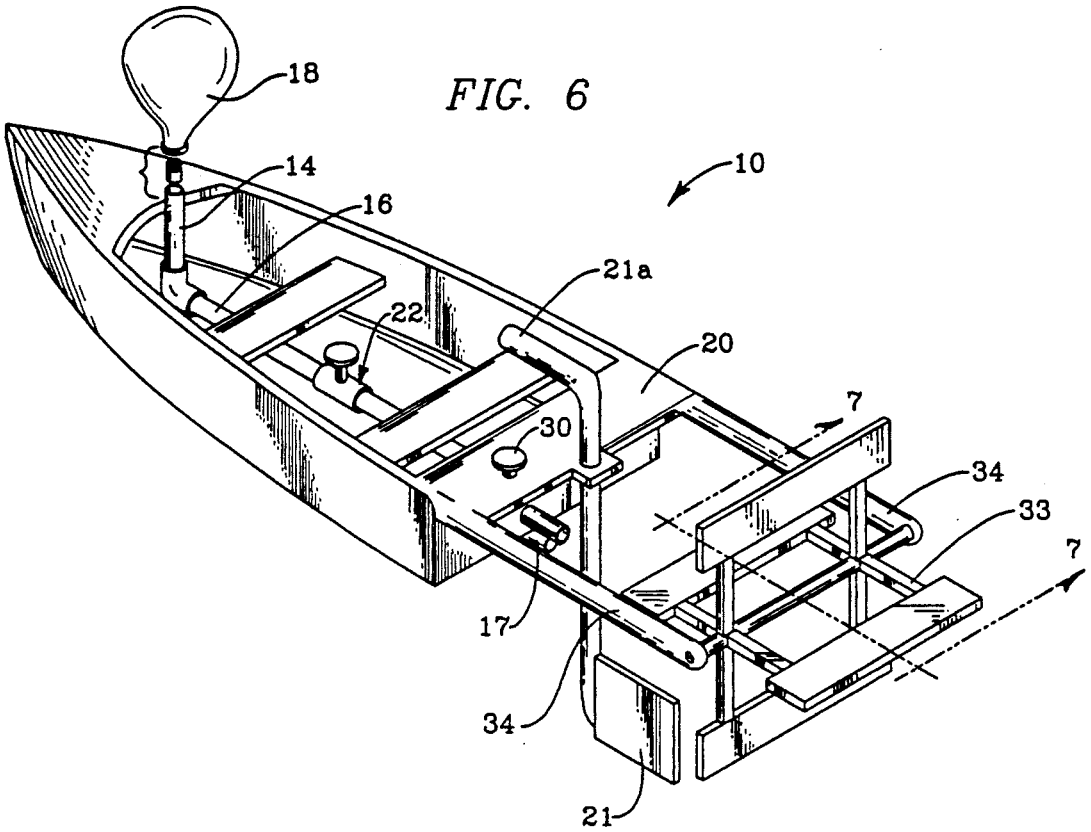
FIG. 6 is an isometric illustration of the invention utilizing an oil dispersing paddle wheel structure.
Figure 7:
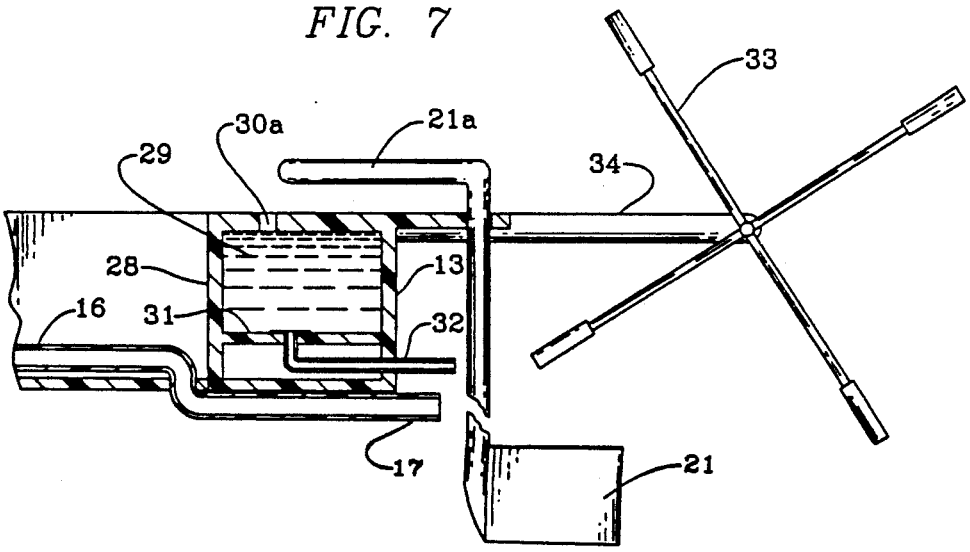
FIG. 7 is an orthographic view, taken along the lines 7—7 of FIG. 6 in the direction indicated by the arrows.

The apparatus 10 as presented in FIG. 6 includes a fluid reservoir 28 positioned in contiguous communication interiorly of the boat hull 11 against the stern plate 13, with the fluid reservoir 28 including a fragrant bath oil 29 contained therewithin that is filled through a fill plug 30 and associated fill opening 30*a*. The reservoir includes a reservoir floor 31 spaced above the boat floor 15 to permit projection of an outlet tube 32 from the reservoir floor 31 through the stern plate 13 to orient the outlet tube 32 adjacent and above the second conduit pipe rear distal end 17 to enhance mixing of the fluid from the reservoir 28. To further enhance such mixing, a plurality of spaced parallel support legs 34 project rearwardly of the stern flange 30 and rotatably mount a paddle wheel 33 whose axis is arranged parallel to the stern plate 13. During use of the organization, the second conduit pipe 16 and its rear distal end 17 in association with the paddle wheel 33 effects admixing of the fluid within the body of water such as a bathtub.

Figure 8:
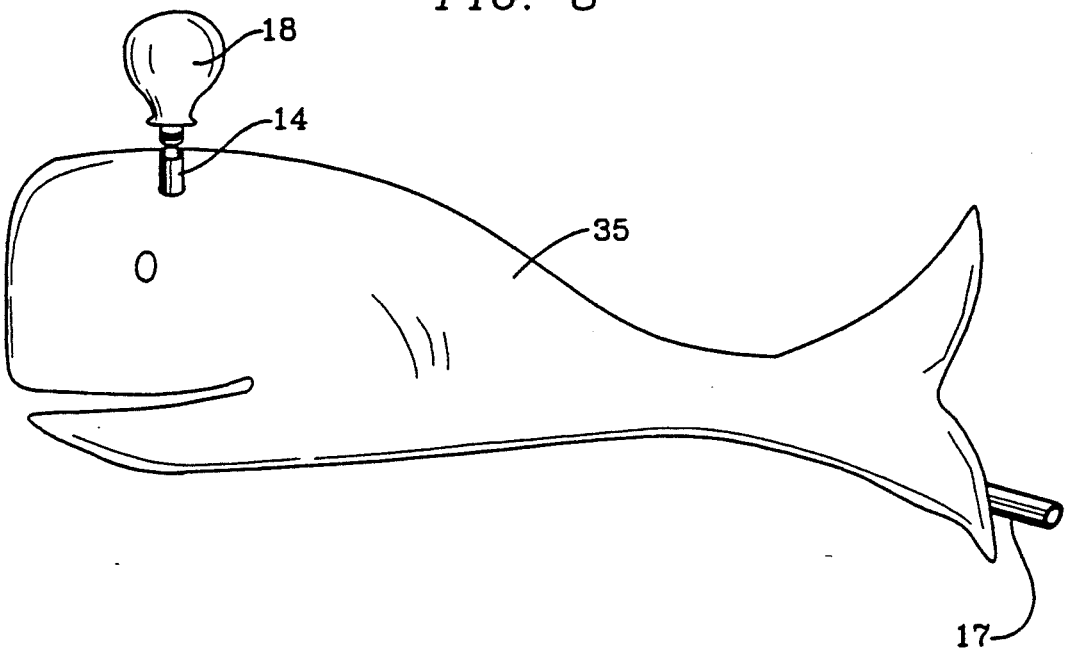
FIG. 8 is an orthographic side view of an enclosed boat structure.
Figure 9:
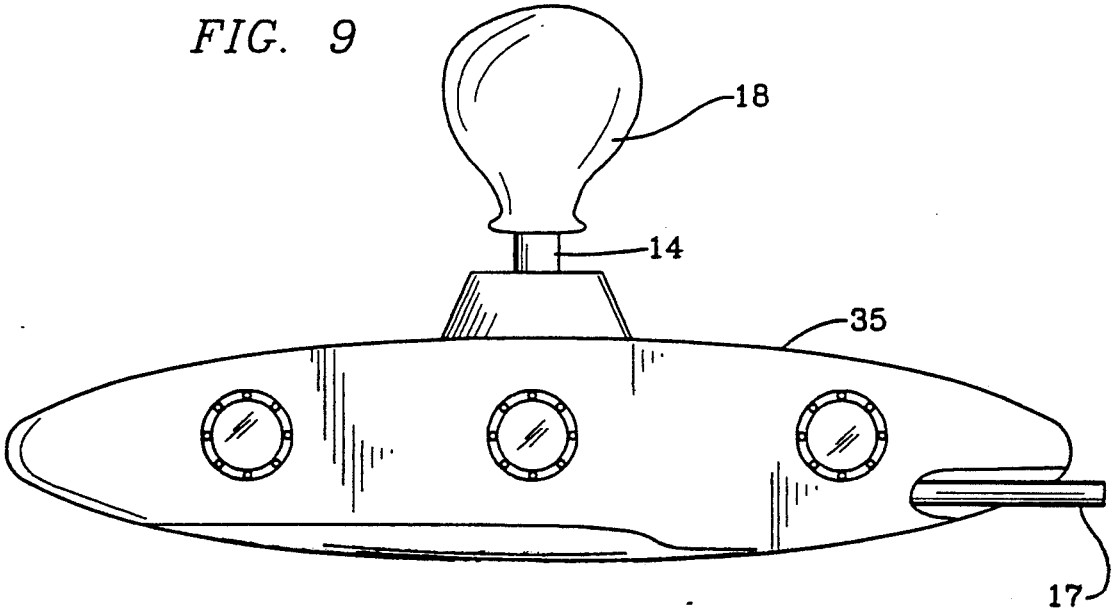
FIG. 9 is an orthographic side view of a modified toy boat structure of an enclosed configuration.

The FIGS. 8 and 9 illustrate an enclosed flotation member 35 mounting the first conduit pipe 14 and the second conduit pipe 16 at its associated rear distal end 17, in a manner as described above. Similarly, a like constructed enclosed flotation member 35 is illustrated in FIG. 9, of varying configuration.

Figure 10:
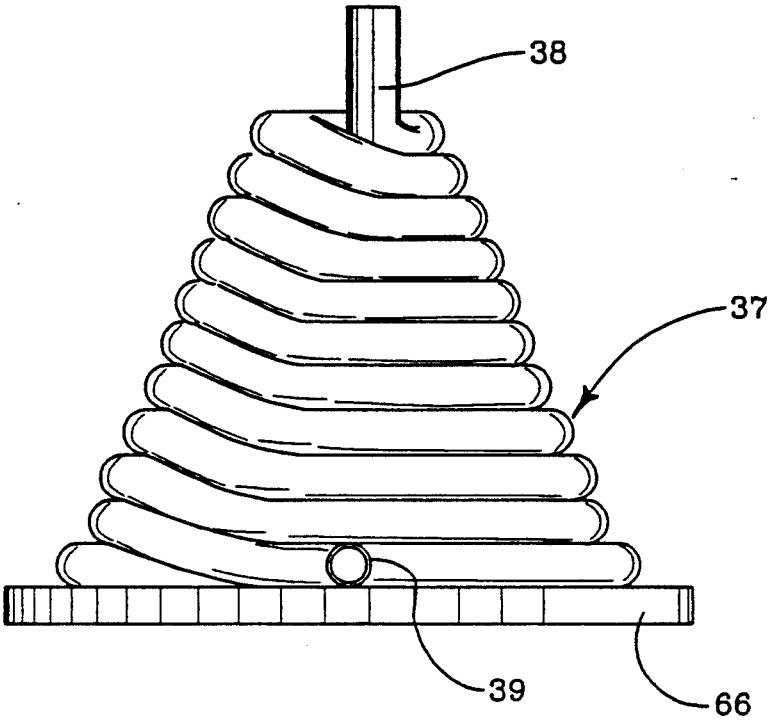
FIG. 10 is an orthographic side view of a helical coiled flotation toy.
Figure 11:
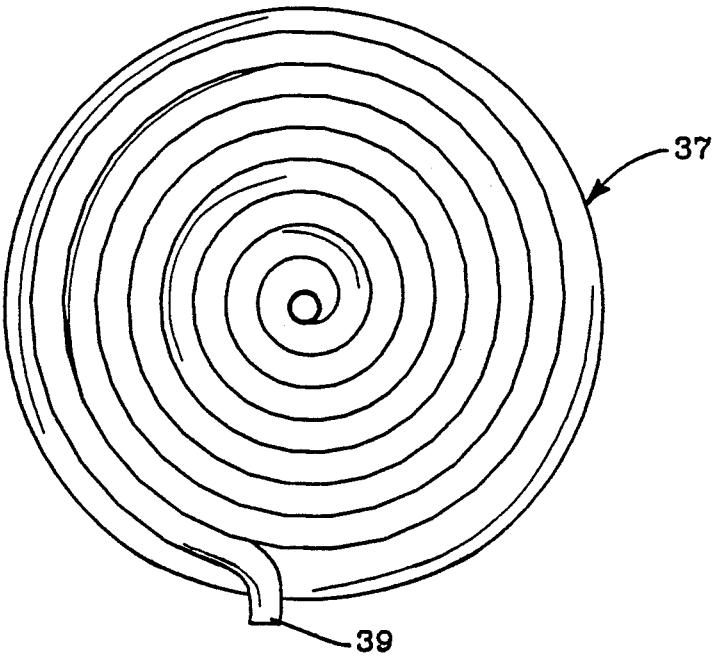
FIG. 11 is an orthographic top view of the toy as set forth in FIG. 10.

The FIGS. 10 and 11 illustrate the use of a helical coil tube 37 mounted to a flotation plate 36, wherein the helical coil tube 37 upper distal end 38 is arranged to receive the balloon 18 and its lower distal end 19 arranged adjacent the flotation plate 36 to effect a spiralling motion in use of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A balloon powered toy boat, comprising, a boat hull, the boat hull including a bow positioned medially of and forwardly of a stern plate, and a boat floor extending coextensively between the boat hull and the stern plate, with spaced side walls extending upwardly relative to the boat floor, and a first conduit pipe mounted to the boat hull, including an upper distal end projecting above the spaced side walls, and the first conduit pipe in pneumatic communication with a second conduit pipe, the second conduit pipe including a second conduit pipe rear distal end projecting rearwardly of the stern plate and exteriorly of the boat hull, with the second conduit pipe rear distal end positioned below the stern plate, and a pneumatic balloon mounted to the upper distal end of the first conduit pipe for directing pressurized air through the first conduit pipe and through the second conduit pipe and exiting the second conduit pipe through the second conduit pipe rear distal end, and a stern flange fixedly mounted in an orthogonal relationship relative to the stern plate, wherein the stern flange extends rearwardly of the stern plate and rearwardly of the side walls of the boat hull, and the stern flange includes a rudder shaft orthogonally projecting through the stern flange, wherein the rudder shaft includes a rudder mounted to a lower distal end of the rudder shaft positioned below the boat floor, and a rudder handle lever mounted at an upper distal end of the rudder shaft, and a second conduit valve mounted within the second conduit pipe to effect pneumatic closure through the second conduit pipe, and the second conduit valve includes a threaded valve rod directed through the second conduit valve and coaxially aligned with a valve rod receiving boss within the second conduit, and the threaded valve rod includes a lower conical end, and the lower conical end coaxially aligned with a conical cavity formed within the receiving boss, and a seal member mounted about the lower conical end to effect sealing of the lower conical end relative to the receiving boss, and a fluid reservoir mounted within the hull adjacent the stern plate, with the fluid reservoir including a fill plug directed through a top wall of the fluid reservoir, and a fluid contained within the reservoir, and the fluid reservoir including a reservoir floor, the reservoir floor spaced above the boat floor, and an outlet pipe directed through the reservoir floor and through the stern plate, with the outlet pipe arranged adjacent to and above the second conduit pipe rear distal end, and a plurality of parallel support legs fixedly mounted to the stern plate projecting rearwardly thereof, and a paddle wheel rotatably mounted to the support legs, wherein the paddle wheel has a paddle wheel axis parallel to the stern plate.

* * * * *